US007603939B2

(12) United States Patent
Cohen

(10) Patent No.: US 7,603,939 B2
(45) Date of Patent: Oct. 20, 2009

(54) CERAMIC BODIES FOR ARMOR PANEL

(76) Inventor: Michael Cohen, Kibbutz Kfar Etzion, Mobile Post North Yehuda, 90200 (IL)

( * ) Notice: Subject to any disclaimer, the term of this patent is extended or adjusted under 35 U.S.C. 154(b) by 0 days.

(21) Appl. No.: 11/188,031

(22) Filed: Jul. 22, 2005

(65) Prior Publication Data

US 2006/0288855 A1 Dec. 28, 2006

Related U.S. Application Data

(63) Continuation-in-part of application No. 10/937,198, filed on Sep. 8, 2004, now abandoned.

(30) Foreign Application Priority Data

Oct. 2, 2003 (IL) ..... 158237

(51) Int. Cl.
*F41H 5/02* (2006.01)

(52) U.S. Cl. ..... 89/36.02; 89/36.05; 89/36.07; 89/36.08

(58) Field of Classification Search ..... 89/36.01, 89/36.02, 36.05, 36.07, 36.08
See application file for complete search history.

(56) References Cited

U.S. PATENT DOCUMENTS

| | | | | |
|---|---|---|---|---|
| 3,607,606 | A * | 9/1971 | Beninga | 428/67 |
| 3,705,558 | A | 12/1972 | McDougal et al. | |
| 4,061,815 | A | 12/1977 | Poole, Jr. | |
| 4,529,640 | A | 7/1985 | Brown et al. | |
| 4,534,266 | A | 8/1985 | Huet | |
| 4,836,084 | A | 6/1989 | Vogelsang et al. | |
| 4,945,814 | A | 8/1990 | Huet | |
| 5,361,678 | A | 11/1994 | Roopchand et al. | |
| 5,763,818 | A | 6/1998 | Guymon et al. | |
| 5,824,940 | A * | 10/1998 | Chediak et al. | 89/36.05 |
| 5,972,819 | A | 10/1999 | Cohen | |
| 6,112,635 | A | 9/2000 | Cohen | |
| 6,203,908 | B1 | 3/2001 | Cohen | |
| 6,289,781 | B1 | 9/2001 | Cohen | |
| 6,408,734 | B1 | 6/2002 | Cohen | |
| 6,497,966 | B2 | 12/2002 | Cohen | |
| 6,601,497 | B2 * | 8/2003 | Ghiorse et al. | 89/36.02 |
| 2003/0167910 | A1 * | 9/2003 | Strait | 89/36.02 |

FOREIGN PATENT DOCUMENTS

| | | |
|---|---|---|
| EP | 0843149 A1 | 5/1998 |
| FR | 2711782 | 5/1995 |
| GB | 1081464 | 8/1967 |
| GB | 1352418 | 5/1974 |
| GB | 2272272 | 5/1994 |
| WO | WO 99/60327 | 11/1999 |

* cited by examiner

*Primary Examiner*—J. Woodrow Eldred
(74) *Attorney, Agent, or Firm*—Connolly Bove Lodge & Hutz LLP; Billy A. Robbins

(57) ABSTRACT

The invention provides a composite armor plate for absorbing and dissipating kinetic energy from high-velocity projectiles, the plate comprising a single internal layer of pellets which are bound and retained in plate form the pellets being characterized by a substantially regular geometric cross-sectional area, the cross-sectional area being substantially polygonal with rounded corners.

6 Claims, 4 Drawing Sheets

CERAMIC BODIES FOR ARMOR PANEL

The present specification is a continuation in part of U.S. Ser. No. 10/937,198, filed on Sep. 8, 2004, now abandoned entitled Ceramic Bodies for Armor Panel.

The present invention relates to a ceramic body for deployment in a composite armor panel, for absorbing and dissipating kinetic energy from projectiles and for ballistic armor panels incorporating the same. More particularly, the invention relates to improved ceramic bodies for use in armored plates for providing ballistic protection for light and heavy mobile equipment and for vehicles against high-velocity, armor-piercing projectiles or fragments.

The present invention is a modification of the inventions described in U.S. Pat. Nos. 5,763,813; 5,972,819; 6,289,781; 6,112,635; 6,203,908; and 6,408,734 and in WO-A-9815796 the relevant teachings of which are incorporated herein by reference.

In U.S. Pat. No. 5,763,813 there is described and claimed a composite armor material for absorbing and dissipating kinetic energy from high velocity, armor-piercing projectiles, comprising a panel consisting essentially of a single internal layer of high density ceramic pellets said pellets having an $Al_2O_3$ content of at least 93% and a specific gravity of at least 2.5 and retained in panel form by a solidified material which is elastic at a temperature below 250° C.; the majority of said pellets each having a part of a major axis of a length of in the range of about 3-12 mm, and being bound by said solidified material in plurality of superposed rows, wherein a majority of each of said pellets is in contact with at least 4 adjacent pellets, the weight of said panel does not exceed 45 kg/m$^2$.

In U.S. Pat. No. 6,112,635 there is described and claimed a composite armor plate for absorbing and dissipating kinetic energy from high velocity, armor-piercing projectiles, said plate consisting essentially of a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length said one axis of substantially all of said pellets being in substantial parallel orientation with each other and substantially perpendicular to an adjacent surface of said plate and wherein a majority of each of said pellets is in direct contact with 6 adjacent pellets, and said solidified material and said plate are elastic.

In WO-A-9815796 there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In U.S. Pat. No. 6,289,781 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

In U.S. Pat. No. 6,408,734 there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

The teachings of all of these specifications are incorporated herein by reference.

As described and explained therein, an incoming projectile may contact the pellet array in one of three ways:

1. Center contact. The impact allows the full volume of the pellet to participate in stopping the projectile, which cannot penetrate without pulverizing the whole pellet, an energy-intensive task.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the substrate or plate, and penetration is prevented.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on composite materials, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

In the majority of the patents by the present inventor, the preferred embodiments are pellets having a cylindrical body and at least one convexly curved end face while as indicated above U.S. Pat. No. 6,408,734 teaches the use of special triangular inserts or pellets in the form of a six sided star with concave sides for filling the interstices between cylindrical pellets.

It has now been found that when using pellets of increased diameter especially for light and heavy armored vehicles for dealing with large projectiles, the valley space between three adjacent cylindrical pellets increases as the diameter of the pellets increase.

While a pellet of regular polygonal cross-section, such as a hexagon, reduces and almost eliminates said valley space, it has been found that the maintenance of a valley space between 3 adjacent pellets has several major advantages including assuring the elasticity and flexibility of the plate, reducing the overall weight of the plate and serving to attenuate the propagation of shock waves between adjacent plates.

With this state of the art and these considerations in mind, there is now provided according to the present invention a composite armor plate for absorbing and dissipating kinetic energy from high-velocity projectiles, said plate comprising a single internal layer of pellets which are bound and retained in plate form said pellets being characterized by a substantially regular geometric cross-sectional area, said cross-sectional area being substantially polygonal with rounded corners.

It has now been found that armor formed with pellets according to the present invention have major advantages in that it enables the use of pellets of large diameter with only a small valley space therebetween.

Thus while the large size pellets described e.g. in U.S. Pat. No. 6,112,635 are effective for stopping larger size projectiles, there is always a danger that a small caliber projectile or a projectile fragment could find its way into the valley gap between said large diameter pellets. As will be realized and as shown with regard to FIGS. 1*a*-1*d* and FIG. 2 the pellets of the present invention result in a much smaller valley gap than that obtained with pellets having cylindrical cross-sections of comparable diameter.

Furthermore, as will be realized and discussed with regard to FIG. 3 hereinafter, the pellets of the present invention are formed by effectively cutting away arcuate segments of a pellet having a cylindrical body and which preferably has at least one convexly curved end face and then cutting away the corners of the polygon formed thereby to form a pellet having a cross-sectional area which is substantially polygonal with rounded corners. As a result, segments of the composite pellet which are less in height than the height of the pellet at its central axis through said convex end face are cut away and therefore the effective height of the pellet encountered by a projectile is increased since the segments which were cut away were the segments of least height of the pellet.

Thus, using pellets according to the present invention to form composite armor plates, one no longer has to worry that an increase in pellet size results in an accompanying increase in valley gap since the size of the valley gap can be controlled by the cross-sectional shape of repeating straight sides and rounded corners created in the pellets according to the present invention.

In preferred embodiments of the present invention said pellets have a substantially hexagonal cross-section with rounded corners, said pellets being oriented so that said cross-section is substantially parallel with an outer impact receiving major surface of said plate.

In the embodiments of the present invention a majority of said pellets preferably have at least one convexly-curved end face oriented to substantially face in the direction of an outer impact receiving major surface of said plate.

It has thus now been found that utilizing the pellets of the present invention according to this preferred embodiment allows a reduction in height of the pellets equal to the difference in height between the cut and the uncut segments thereof since projectiles react to the entire height of a pellet at their point of impact including the height of the convex end face.

In the preferred embodiments of the present invention said pellets have at least one axis of at least 9 mm and the present invention is especially applicable and preferred for use with plates incorporating pellets having at least one axis of at least 20 mm.

The solidified material can be any suitable material, such as aluminum, a thermoplastic polymer such as polycarbonate, or a thermoset plastic such as epoxy or polyurethane and in preferred embodiments of the present invention said solidified material and said plate are elastic.

When aluminum is used as said solidified material an x-ray of the plate shows the formation of a honeycomb structure around the pellets.

The term "regular geometric" as used herein refers to forms that are regular multiple repeating patterns of alternating straight and curved segments characterized in that a cut along said regular geometric cross-sectional area or perpendicular thereto results in two surfaces which are symmetrical.

The term "elasticity" as used herein relates to the fact that the plates according to the present invention are bent when a load is applied thereto however upon release of said load the plate returns to its original shape without damage.

The armor plates described in EP-A-0843149 and U.S. Pat. No. 6,112,635 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using pellets made of sintered refractory materials or ceramic materials having a specific gravity below that of aluminum oxide, e.g., boron carbide with a specific gravity of 2.45, silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdenum, titanium and silica can be used and especially preferred for use in said publication and also in the present invention the ceramic bodies utilized herein are formed of a ceramic material selected from the group consisting of sintered oxide, nitrides, carbides and borides of alumina, magnesium, zirconium, tungsten, molybdenum, titanium and silica.

All of these features are incorporated herein as preferred embodiments of the present invention.

More particularly, the present invention relates to a ceramic body as defined for absorbing and dissipating kinetic energy from high velocity armor piercing projectiles, wherein said body is made of a material selected from the group consisting of alumina, boron carbide, boron nitride, titanium diboride, silicon carbide, silicon oxide, silicon nitride, magnesium oxide, silicon aluminum oxynitride and mixtures thereof.

In U.S. Ser. No. 09/924,745 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments described therein each of said channels occupies a volume of up to 25% within its respective pellet.

Said channels can be bored into preformed pellets or the pellets themselves can be pressed with said channel already incorporated therein.

The teachings of said specification are also incorporated herein by reference.

Thus, in preferred embodiments of the present invention a channel is provided in the pellets of the armor of the present invention to further reduce the weight per area thereof and preferably said channel occupies a volume of up to 25% of said body.

In accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

As will be realized, since material is removed from the pellets of the present invention their weight is decreased, as is the overall weight of the entire composite armor plate from which they are formed, thereby providing the unexpected improvement of reduced weight of protective armor panels without loss of stopping power, as shown in the examples hereinafter.

In preferred embodiments of the present invention said pellets each have a major axis and said pellets are arranged with their major axes substantially parallel to each other and oriented substantially perpendicularly relative to said outer impact-receiving major surface of said panel.

Thus, in preferred embodiments of the present invention there is provided a composite armor plate as herein defined, wherein a majority of said pellets have at least one convexly-curved end face oriented to substantially face in the direction of an outer impact receiving major surface of said plate.

In especially preferred embodiments of the present invention there is now provided a composite armor plate for absorbing and dissipating kinetic energy from high-velocity projectiles, said plate comprising a single internal layer of pellets which are bound and retained in plate form by an elastic material, substantially internally within said elastic material, such that the pellets are bound in a plurality of spaced-apart rows and columns, said pellets being made of ceramic material, and said pellets being substantially fully embedded in the elastic material so that the pellets form an internal layer, said pellets being characterized by a substantially regular geometric cross-sectional area, said cross-sectional area being substantially polygonal with rounded corners and wherein a majority of each of said pellets is substantially in direct contact with six adjacent pellets in the same layer to provide mutual lateral confinement therebetween.

While the cylindrical pellets of this preferred embodiment are defined as being substantially in direct contact with six adjacent pellets, it is known that a ceramic body which has been pressed, by it's nature, has an external surface area which is not smooth and has lack of consistency in its diameter along the main axis, and it is because of this that when casting the panel with the solidified material, the casting materials such as resin, molten alumina, epoxy, etc., seeps into all spaces between the ceramic bodies such as between cylinders and spheres and the like, including the very small space found between the walls of two or more adjoining cylinders, forming a natural retaining substance in which the ceramic bodies are confined. Thus even when the ceramic bodies are closely packed, the casting material will at least partially penetrate between any two bodies. This is due to the fact that during the pressing process, the ceramic material is compacted in the die and when the material is released from the die the material has a tendency to try and spring back to a less compact form. This generally occurs in the top part of the material so pressed, which is the first part of the body released from the die. Thus, in this case, there will be a small difference in the diameter of the body along the vertical axis. Secondly, it is well known that during the pressing process there are sometimes differences in densification of the powder in different areas of the ceramic body. When sintering the ceramic body, these small differences will cause the body to shrink in accordance with the different compressions found in various areas of the body, resulting in another reason for a small lack of homogeneity in the diameter along the vertical axis of the body. Thus there is rarely a situation in which one ceramic body is perfectly in direct contact with a second ceramic body in the panel along its entire vertical surface, rather, the casting material will seep between the two bodies, at least partially encasing each of said bodies, thus creating at least a partial honey-comb sleeve, that at least partially enwraps the ceramic body, and the term substantially in direct contact, is intended to also denote this possibility.

Furthermore, when the casting material of the plate is a liquefied solid material, if one were to x-ray the panel, one would see that the panel shows a honey-combed shaped casting, which at least partially encloses the ceramic bodies. Since this is the case, it is possible also to first cast such a partial honey-combed shape and then to place the special insert pellets and the other pellets in the proper configuration therein.

Furthermore, because of the support this ceramic body receives from the backing layers, one may distance the ceramic cylinders or said ceramic bodies, one from another, until V50 penetration for 7.62 mm ammunition at muzzle velocity is attained.

For Standard Ceramic bodies, such as ceramic cylinders, with similar convex domes based on small radii, which are even somewhat reminiscent of a ball, there are small contact points with the backing material, and with adjacent bodies, and when impacted by a projectile in any side of the cylinder, or ceramic body, the cylinder or ceramic body may have a tendency to tumble or turn and allow the projectile to lightly penetrate without breaking the ceramic body because of the high structural strength of the ceramic body. In contradistinction, a ceramic body or cylinder, having a cross-sectional area which is substantially polygonal with rounded corners, allows the cylinders to spread the energy over a larger surface area and has a far less tendency to twist or turn or tumble upon said projectile impact, which further allows for the ceramic cylinders or ceramic bodies to be set further apart from one another. In order to provide for homogeneity of distance between all of the ceramic cylinders or bodies used in such a fashion, these bodies can be wrapped or encapsulated by rings made from various materials such as aluminum or any material with a low aerial density so long as the rings made from these materials will maintain equal distance between the ceramic bodies mentioned above.

In like fashion, it is possible to place the ceramic cylinders or ceramic bodies into a honey-comb structure, which has been previously fashioned, when the thickness of the walls of the honey-comb will allow the cylinders or ceramic bodies to maintain equal distance one from the other as mentioned above while preferably allowing for valley contact between adjacent bodies as discussed herein.

In the event that it is desirable to insure a situation in which the ceramic cylinders or ceramic bodies are distanced one from another and still retain their full ballistic resistance capabilities one may add an "ear" or a pin-like protrusion to the ceramic body which acts to sufficiently slow and erode the penetrating projectile or fragment. By adding this pin-like protrusion or ear to the ceramic cylinder or ceramic body, the contact valley effect that has been described herein, is improved in comparison to the contact-valley effect found in the absence of such pin-like protrusions or ears. This is also the case when the ceramic bodies or cylinders are not separated one from another by any distance and are substantially at least partially in contact with each other.

This pin-like protrusion or ear can be either a part of the ceramic body or cylinder or can be a separate ceramic body onto itself.

When the pin-like protrusion or ear is not a part of the ceramic cylinder or body, but is, in itself, a separate entity, it can be made of ballistic materials with a high hardness such as ceramics or high hard metals or any other materials with a high hardness which are wear resistant.

The pin can be roll shaped, ball shaped, pyramidal, or prismatic or any shape that can resist and erode the impacting projectile. Because of the fact that the ceramic body has already defeated the impacting projectile the purpose of the pin is merely to diminish the potential speed of the resulting fragments.

When it is desirable to insure equal distance between the ceramic cylinders or ceramic bodies, these bodies can be wrapped or encapsulated by rings made from various materials such as aluminum or any material with a low aerial density as has been previously mentioned and when this is done to ceramic cylinders or ceramic bodies which are used in conjunction with the pin-like protrusions or ears previously described the pin or ears both diminish the impacting speed of the fragments or projectiles and also erode them. In like manner, the cylinders with pins or ears can be placed in a pre-formed honeycomb as previously described.

Thus, the afore-described bodies can be united or bonded inside any unifying material in a single layer. This uniting or bonding material can be made from materials such as a thermoplastic polymer, e.g., a polycarbonate, or can be made from a thermoset plastic such as epoxy or polyurethane, or from aluminum, magnesium, steel, etc.

The panel that is based on cylinders or ceramic bodies bonded together inside a unifying or bonding material, is a ballistic panel designed to resist projectile penetration. However, when it is desirable to improve the ballistic tendency of said panel against multi-impacting projectiles or against improvised explosive device (IED) threats, it is possible to add materials that will improve the panel's over-all resistance and ability to defeat threats, such as Kevlar, Fiber Phenol, aluminum, titanium or perforated steel, or any of them in any combination, or, in like manner, to cast them in a box which has been previously prefabricated in accordance with the desired structural characteristics.

In like manner, it is also possible to add to the panel, either frontally, behind the panel, or on any of its sides, or in any combination, materials or a combination of materials, which will improve the structural strength of the panel improving its ability to stand against both multi-impact and IED threats.

In French Patent 2,711,782, there is described a steel panel reinforced with ceramic materials; however said panel does not have the ability to deflect armor-piercing projectiles unless a thickness of about 8-9 mm of steel is used, which adds undesirable excessive weight to the panel and further backing is also necessary thereby further increasing the weight thereof.

The composite armor plate according to the present invention can be used in conjunction with and as an addition to the standard steel plates provided on armored vehicles as well as in conjunction with the laminated armor described and claimed in U.S. Pat. No. 6,497,966 the teachings of which are incorporated herein by reference.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising a ballistic material for absorbing the remaining kinetic energy from said fragments. Said ballistic material will be chosen according to cost and weight considerations and can be made of any suitable material such as Dyneema, Kevlar, aluminum, steel, titanium, or S2, or any combination thereof.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 mm and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

As will be realized, when preparing the composite armor plate of the present invention, said pellets do not necessarily have to be completely covered on both sides by said solidified material, and the term internal layer as used herein is intended to denote that the pellets are either completely or almost completely covered by said solidified material, wherein outer face surfaces of the plate are formed from the solidified material, the plate having an outer impact receiving face, at which face each pellet is either covered by the solidified material, touches said solidified material which forms surfaces of said outer impact receiving face or, not being completely covered by said solidified material which constitutes surfaces of said outer impact receiving face, bulges therefrom, the solidified material and hence the plate being elastic.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 1*a*, 1*b*, 1*c* and 1*d* are cross-sectional views of arrangements of pellets of different diameters according to the prior art;

Figure 4A:
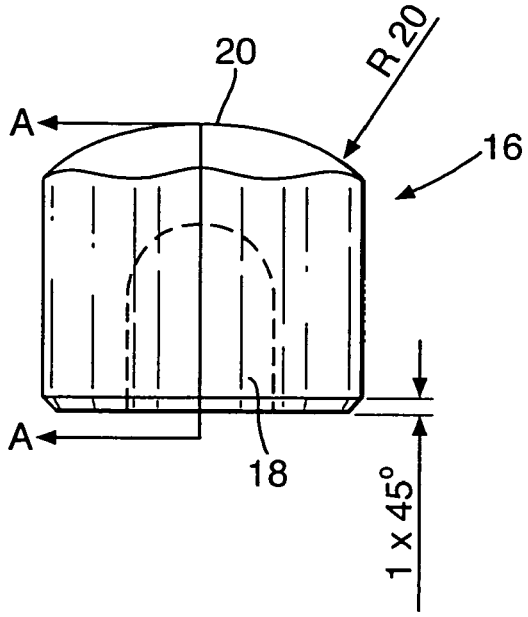
Figure 4B:
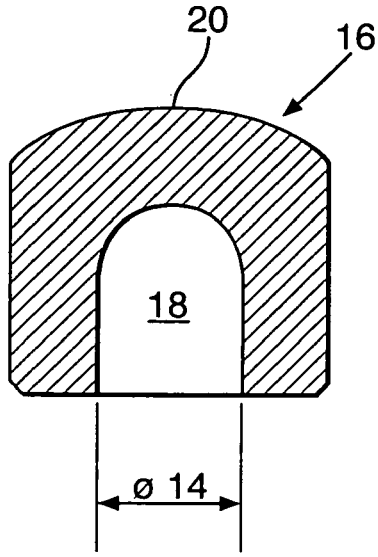
Figure 4C:
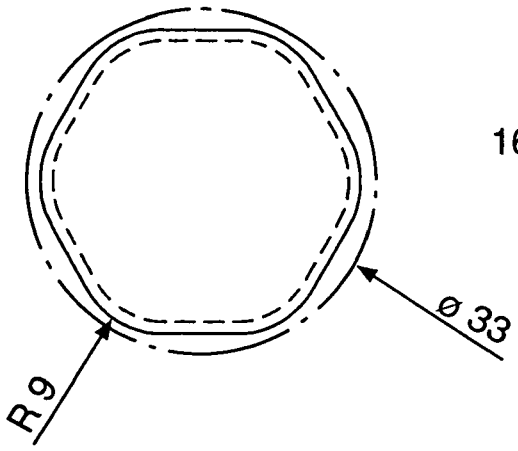

FIG. 4*a* is a side view of a pellet according to the present invention;

FIG. 4*b* is a cross-section of the pellet of FIG. 4*a* taken along lines A-A;

FIG. 4*c* is a top view of the pellet of FIG. 4*a;*

Figure 4D:
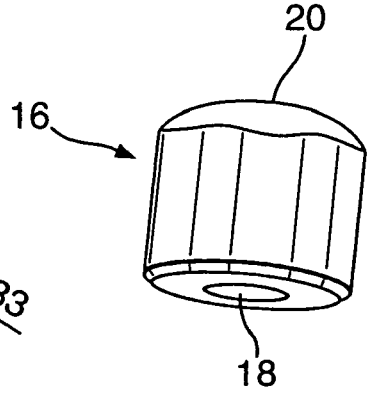

FIG. 4*d* is a perspective of the pellet of FIG. 4*a;*

Figure 5A:
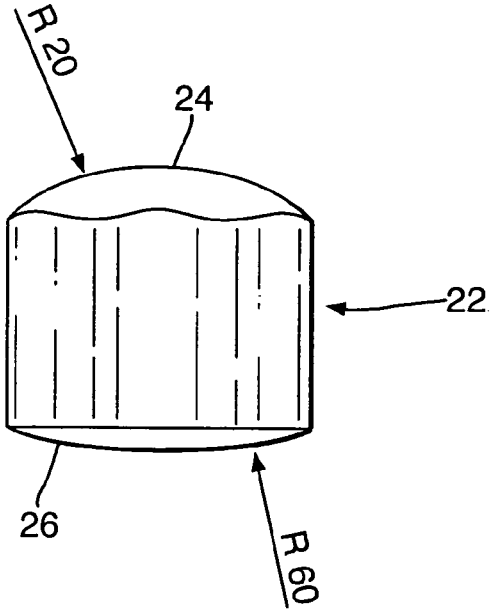
Figure 5B:
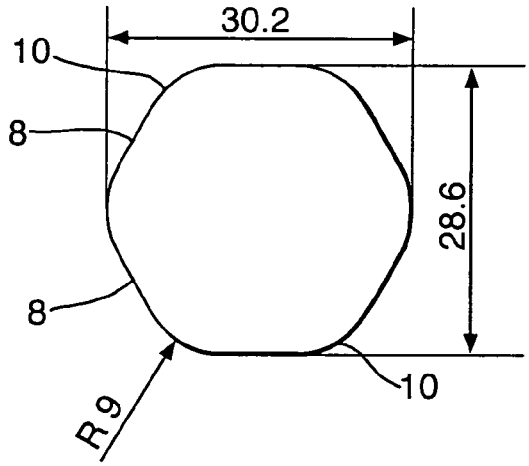

FIG. 5*a* is a side view of a preferred pellet according to the present invention;

FIG. 5*b* is a cross-sectional view of the pellet of FIG. 5*a*; and

Figure 5C:
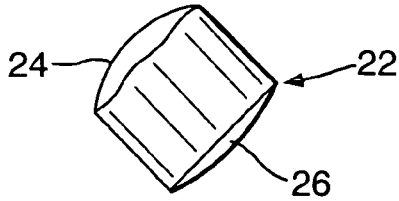

FIG. 5*c* is a perspective view of the pellet of FIG. 5*a*.

Figure 1A:
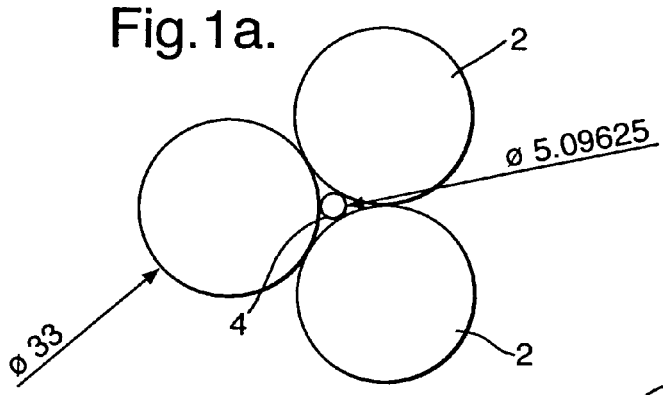

Referring to FIG. 1*a* there is seen a cross-sectional view of an arrangement of pellets 2 according to the prior art, such as that described and claimed in U.S. Pat. No. 6,112,635 wherein each pellet is of circular cross-section, each pellet having a diameter of 33 mm wherein the valley 4 formed between three adjacent pellets 2 has a diameter of 5.09625 mm.

Figure 1B:
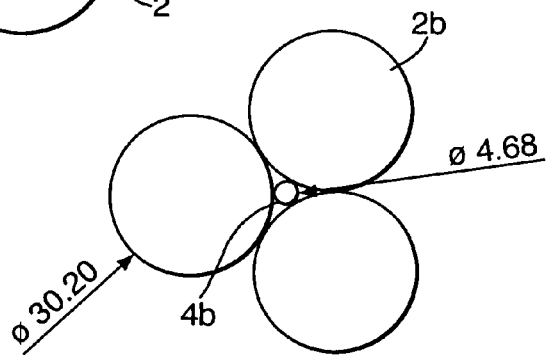
Figure 1C:
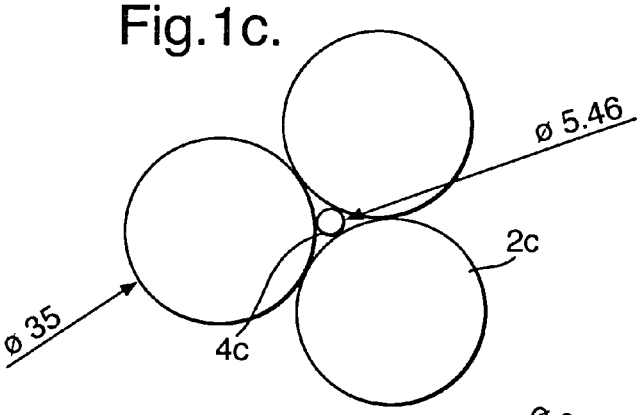
Figure 1D:
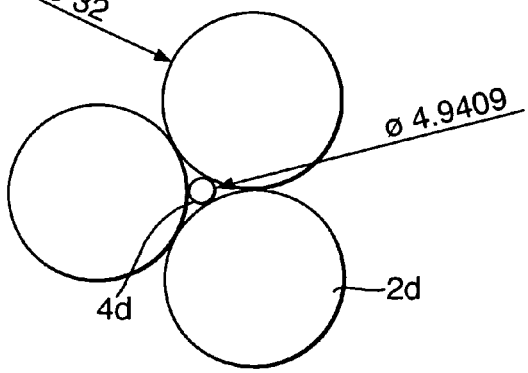

Referring to FIGS. 1*b*, 1*c* and 1*d* there are seen cross-sectional views of an arrangement of pellets 2*b*, 2*c* and 2*d* respectively wherein each pellet is of circular cross-section and wherein said pellets have respective diameters of 30.20 mm, 35 mm and 32 mm and wherein the valleys 4*b*, 4*c* and 4*d* form between three adjacent pellets have a respective diameter of 4.68 mm, 5.56 mm and 4.9409 mm.

Figure 2:
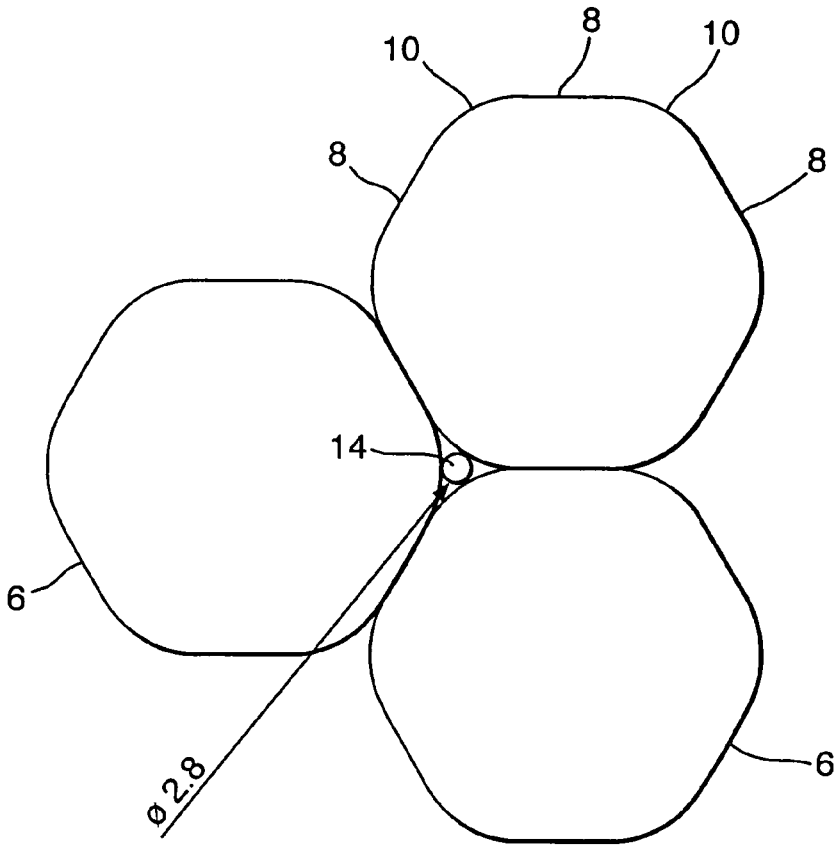
FIG. 2 is a cross-sectional view of an arrangement of pellets according to the present invention.

Referring to FIG. 2 there is seen a cross-sectional view of an arrangement of pellets 6 according to the present invention wherein each pellet is of hexagonal cross-section with rounded corners, i.e. the pellet has multiple repeating patterns of alternating straight sides 8 and curved corners 10 there being six substantially straight side segments 8 and six curved corners 10.

Figure 3:
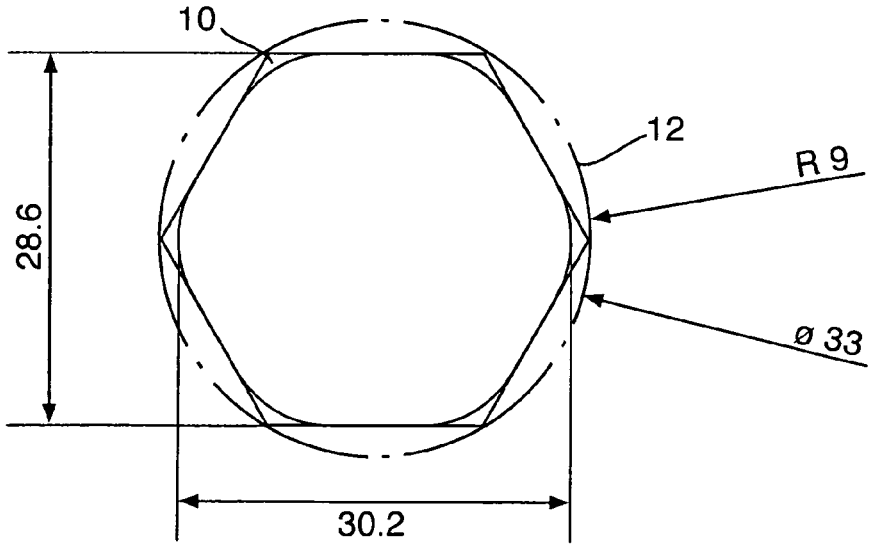
FIG. 3 is a top view of a pellet according to the present invention showing different dimensions relevant thereto.

Referring to FIG. 3 it can be seen that the pellets according to the present invention are theoretically equivalent to taking a pellet 2 of cylindrical cross-section as shown in FIG. 1*a*, cutting arcuate segments 12 thereof to form a hexagon and then cutting the corners of said hexagon to form rounded corners 10 as shown in FIG. 2. Assuming an original diameter of the cross-section of pellet 2 to be 33 mm which is the diameter of the pellets of FIG. 1*a*, the resulting diameter of the pellet formed according to the present invention will be 30.2 mm which is the diameter of the pellets of FIG. 1*b*. Nevertheless the diameter of the valley 14 formed between the three pellets 6 according to the present invention is only 2.8 mm which is substantially smaller than the valley formed between pellets 2 of FIG. 1*a* or even the valley formed between pellets 2*b* of FIG. 1*b*.

Referring to FIGS. 4*a*, 4*b*, 4*c* and 4*d* there are seen different views of a preferred pellet 16 according to the present invention said pellet 16 being hexagonal in cross-section with rounded corners however being provided with a channel 18 substantially opposite to an outer impact-receiving convexly curved end face 20 of said pellet 16 thereby reducing the weight per area of each of said pellets.

Referring to FIGS. 5*a*, 5*b* and 5*c* there are seen different views of an especially preferred pellet 22 according to the present invention said pellet 22 being hexagonal in cross-section with rounded corners, i.e. the pellet has multiple repeating patterns of alternating straight sides 8 and curved corners 10 there being six substantially straight side segments 8 and six curved corners 10 and said pellet being further provided with two convexly curved end faces 24 and 26.

The pellets 6, 16 and 22 are all formed of a ceramic material. Preferred ceramics are sintered oxide, nitrides, carbides and borides of alumina, magnesium, zirconium, tungsten, molybdenum, titanium and silica.

Preferred materials are typically alumina, boron carbide, boron nitride, titanium diboride, silicon carbide, silicon oxide, silicon nitride, magnesium oxide, silicon aluminum oxynitride and mixtures thereof.

While not shown, the plates of the present invention or at least the outer surface thereof can be furthered covered by a thin layer of kevlar, fiberglass, or even aluminum for protection and for concealing the structure thereof.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate comprising:

a single internal layer of pellets made of ceramic material disposed in a plurality of spaced-apart rows and columns, which are bound and retained in plate form by an elastic material;

a majority of said pellets having at least one convexly curved end face;

an outer impact receiving major surface defined by said convexly curved end faces of said pellets for absorbing and dissipating kinetic energy from high-velocity projectiles;

said convexly curved end faces of said pellets receiving impact from high-velocity projectiles and absorbing and dissipating kinetic energy therefrom;

said pellets having a substantially regular polygonal outer surface with the corners of the polygon being eliminated to form rounded corners;

a majority of each of said pellets being in direct contact with six adjacent pellets in the same layer to provide mutual lateral confinement there between to trap said high-velocity projectiles;

a valley space being defined between three adjacent pellets, said valley space being substantially smaller than a valley space defined by three cylindrical pellets having a diameter the same as said polygonal pellets with rounded corners; and a plurality of said pellets defining an opening extending into said pellet from a surface opposite to said outer impact receiving convexly cured end face of said pellet to reduce the weight per area thereof.

2. A composite armor plate according to claim 1, wherein said opening occupies a volume of up to 25% of said pellet and said valley space is approximately 2.8 mm.

3. A composite armor plate according to claim 2, wherein said pellets have at least one axis of at least 9 mm.

4. A composite armor plate according to claim 2, wherein said pellets have at least one axis of at least 20 mm.

5. A composite armor plate according to claim 2 wherein each of said pellets is formed of a ceramic material selected from the group consisting of sintered oxide, nitrides, carbides and borides of alumina, magnesium, zirconium, tungsten, molybdenum, titanium and silica.

6. A composite armor plate according to claim 2, wherein each of said pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

* * * * *